US007878952B2

(12) United States Patent
Fenelon

(10) Patent No.: US 7,878,952 B2
(45) Date of Patent: Feb. 1, 2011

(54) BALANCED CIRCULAR FREE WEIGHTS

(76) Inventor: Paul J. Fenelon, 13 Inveraray, Nashville, TN (US) 37215

( * ) Notice: Subject to any disclaimer, the term of this patent is extended or adjusted under 35 U.S.C. 154(b) by 174 days.

(21) Appl. No.: 12/144,809

(22) Filed: Jun. 24, 2008

(65) Prior Publication Data

US 2009/0318273 A1 Dec. 24, 2009

(51) Int. Cl.
*A63B 21/06* (2006.01)
*A63B 21/075* (2006.01)

(52) U.S. Cl. ..... 482/93; 482/108

(58) Field of Classification Search ..... 482/44, 482/45, 49, 50, 92, 93, 106–109, 139, 148; 446/26–28, 40, 69, 236
See application file for complete search history.

(56) References Cited

U.S. PATENT DOCUMENTS

D274,283 S * 6/1984 Wright ..... D21/682
4,575,074 A * 3/1986 Damratoski ..... 482/93
4,632,391 A * 12/1986 Orak ..... 482/110
5,607,379 A * 3/1997 Scott ..... 482/107
D438,265 S * 2/2001 Fenelon ..... D21/682
6,461,282 B1 * 10/2002 Fenelon ..... 482/106
D480,438 S 10/2003 Walkow
6,730,004 B2 * 5/2004 Selsam ..... 482/93
7,014,598 B2 * 3/2006 Fenelon et al. ..... 482/107
2003/0096683 A1 * 5/2003 Fenelon et al. ..... 482/107
2006/0073951 A1 * 4/2006 Walkow ..... 482/109
2009/0075792 A1 * 3/2009 Stugart ..... 482/93

* cited by examiner

*Primary Examiner*—Loan Thanh
*Assistant Examiner*—Allana Lewin
(74) *Attorney, Agent, or Firm*—Miller & Martin PLLC

(57) ABSTRACT

Architectural parameters are provided for the dimensions of sets of balanced circular free weights so that the weights may maintain a consistent style in appearance over a range of weights while retaining their functionality.

20 Claims, 7 Drawing Sheets

50 lb weight series with different internal angles $\theta$. Outside diameter, Do, at Height, H, are visual in unison.

BALANCED CIRCULAR FREE WEIGHTS

FIELD OF THE INVENTION

The present invention relates to free weights and more particularly to circular free Weights designed for use in a set.

BACKGROUND OF THE INVENTION

The concept of balanced circular free weights was introduced in February 2001 through U.S. Design Pat. No. D438,265S and subsequently in U.S. Design Pat. No. D480,438 issued to Walkow in October 2003. Neither of these circular weight concepts have been commercialized due to singularity and lack of the designs presented teaching the necessary non-obvious interplay between the controlling architectural parameters for a set of free weights, i.e., weight (W), height (H), inside diameters ($D_i$), outside diameters ($D_o$), handle diameters ($D_h$), edge contour ($\tau$), inside surface draft angle ($\theta$) and the angle ($\alpha$) between the plane of the weight ($P_w$) and the axis of the holding arm, so that a functional set of weights would result. This patent application teaches this non-obvious interplay of parameters so that sets-of-weights may be readily and economically manufactured.

Functional sets of circular weights have unique features that set them apart from historical free weights, i.e., dumb-bells and kettle bells. In essence, balanced circular free weights can do everything dumb-bells and kettle bells can do alone and more. This is mainly because of the balanced circular design which virtually eliminates unwanted force moments and provides for a glove-like fit allowing for freedom of motion covering a wide range of functional multi-dimensional dynamic exercises. Additionally, circular free weights may be manufactured economically using single castings hence eliminating the need for welding or screwing of multiple parts together. This single casting also provides long life and permanence, eliminating potential assembly failures that have historically caused safety issues, particularly with heavier dumb-bells in the range of 20 or 25 pounds or more.

SUMMARY OF THE INVENTION

A set of free weights is provided with a generally uniform appearance that is safe and convenient to use and that has optimized design parameters across a range of weights in the set, and especially across the heavier weights.

BRIEF DESCRIPTION OF THE DRAWINGS

The invention may be better understood with reference to the following drawings in which the numeral designate like parts and wherein.

DETAILED DESCRIPTION OF THE INVENTION

Figure 1C:
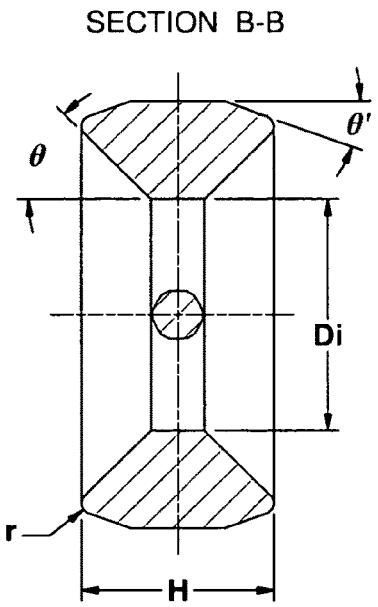
FIG. 1C is a top sectional view of the circular free weight of FIG. 1B taken along line B-B.
Figure 1A:
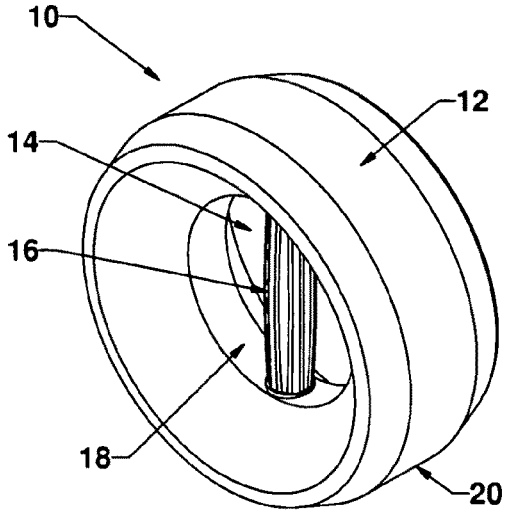
FIG. 1A is a perspective view of a circular weight according to the invention.
Figure 1B:
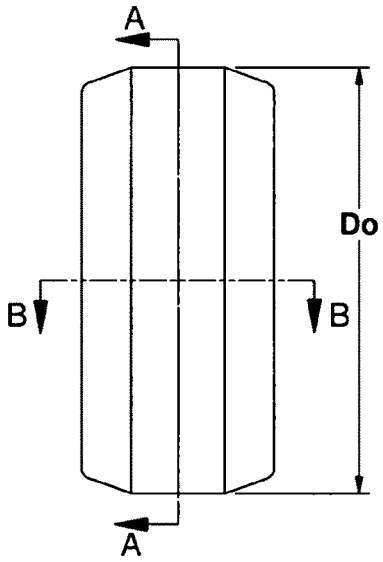
FIG. 1B is a front plan view of the circular free weight of FIG. 1A.
Figure 1D:
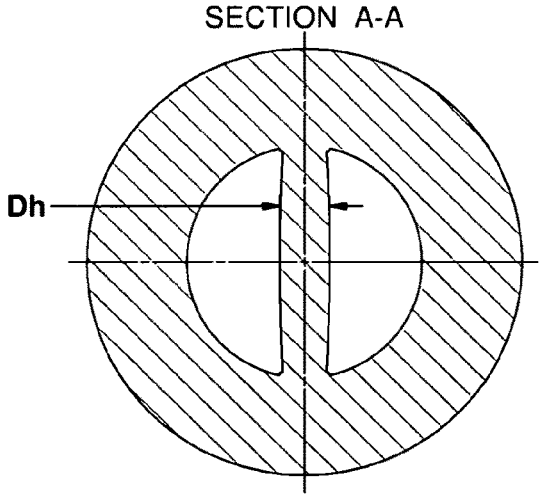
FIG. 1D is a side sectional view of a free weight of FIG. 1B taken along the line A-A.

A circular free weight 10 is illustrated in FIG. 1A. The free weight 10 has a circular weight 12 with an opening 14 in the center defined by inner diameter $D_i$. A handle 16 extends across a diameter of the opening 14, said handle 16 having a handle diameter $D_h$. The central inner surface 18 of the circular weight member 12 is preferably planar and at right angles to the axis of handle 16. The circular weight member 12 proceeds outward in each direction from the central inner surface 18 at an inner draft angle $\theta$ to a total length of H, the height of resting weight 10 when the handle 16 is parallel to the resting surface. At the total length or height H, there is a radius of curvature r (or $\tau$) and the periphery of the circular weight member 12 proceeds inward at an outer inverse draft angle $\theta'$ to central outer surface 20. Weight denominations may be conveniently embossed or cast into the central outer surface 20 especially when the central outer surface is generally planar.

The approximate weight of a given circular free weight is given by the formula:

$$w = \rho\left(\frac{\pi D_o^2 H}{4} - \frac{\pi D_i^2 H}{4}\right) \tag{1}$$

where $\rho$=pig iron density. Therefore $$w = \frac{\rho\pi}{4} \quad H(D_o^2 - D_i^2) \tag{2}$$

$D_i$ for all weights is assumed constant as is $D_h$, the handle diameter. So we conclude:

$$w = kHD_o^2 \tag{3}$$

where k is a constant.

Hence at constant height H, weight is proportional to $D_o^2$ and at constant $D_o$, weight is proportional to height, H. In the ideal situation, both H and $D_o$ need to be minimized. For a circular weight of 100 pounds, with an inside diameter, $D_i$, of 5.5 inches, and a hand grip diameter of 1.25 inches (dimensions selected to accommodate 95% of the population) at a minimum height H of approximately 1.25 inches, $D_o$ would be 20 inches. Similarly, at a minimum $D_o$, of between 5 and 6 inches, the height H would be approximately 40 inches. Thus, at a minimum height H, the resulting free weight would have the appearance of a large flat plate and at the minimum outside diameter $D_o$, the free weight would have the appearance of a 40 inch long tube. Both extremes are unacceptable from the functional use perspective. Therefore, a necessary compromise is dictated between the controlling architectural parameters so that a consistent set of free weights may be designed and manufactured.

To maintain the glove-like feel and dynamic functionality of the free weights, it is desirable that:

1) The weight is centered around the hand, so that the total height, H, is less than 7 inches, preferably 6 inches, more preferably 4.5 inches, and ideally less than or equal to 2.5 inches.

2) In the vertical position, when the weight is held down alongside the user's thigh, an outside diameter $D_o$ of less than 13 inches is preferred, more preferably 12 inches, and most preferably less than 10 inches, and ideally less than or equal to 7.5 inches.

Figure 2:
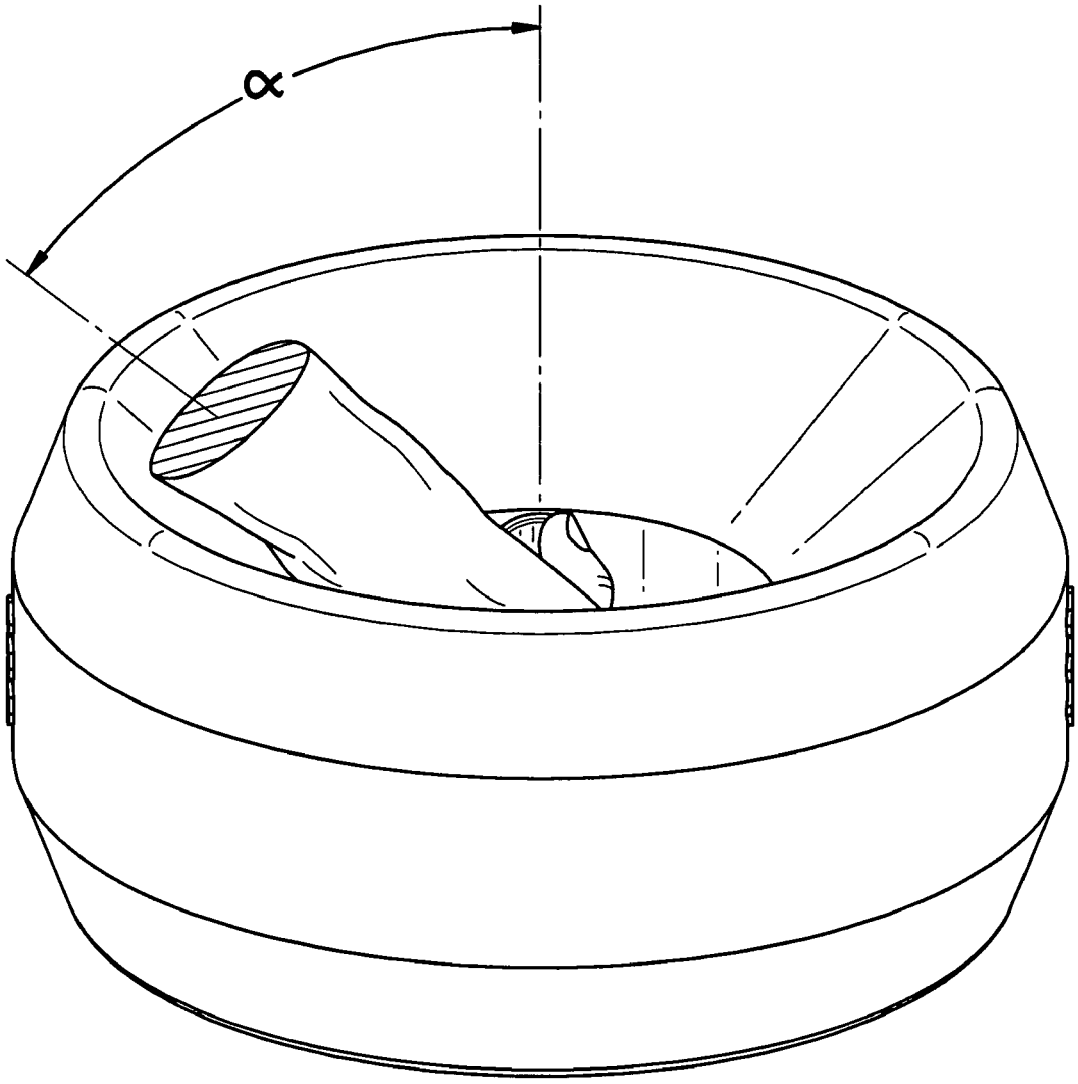
FIG. 2 is an illustration of a circular free weight according to the present invention in use illustrating an angle $\alpha$ between the plane of the weight and the axis of the user's arm.

3) When the weight is rotated towards the wrist and arm, such as during curling exercises, it is desired that the angle $\alpha$ as shown in FIG. 2, between the arm and flat plane of the weight, be minimized so that there is no encroachment point contact upon the upper wrist of the user during lifting. Hence, the inside surface needs to have a draft angle $\theta$ of 10° or more as the range of the weight set is increased. For example, most weight sets which extend to 50 pounds and beyond, draft angles $\theta$ of 20° to 70° are preferred, most preferably 30° to 60°, and ideally in the range of 40° to 50°.

4) When encroachment contact occurs between the wrist and inside outer edge of the weight, as shown in location A in FIG. 2, there should be no sharp interface with the wrist, so that generous round edges having a radius of curvature ($\tau$ or r) of at least 0.125 inches and preferably 0.25 inches are provided. The rounded edges are particularly necessary for weights where the height H exceeds 3 inches, as is typically the case for weights in excess of about 15 pounds.

5) For a given weight set the angle $\alpha$ should be minimized. Angle $\alpha$ is minimized at a given inner diameter $D_i$ when $\theta$ is maximized. As $\theta$ is increased, either outer diameter $D_o$ or height H, or both, must increase, hence $\theta$ is determined by controlling height and outer diameter.

6) For identification and aesthetic purposes, outer diameter $D_o$ and height H should increase incrementally as the weight of each hand weight in the set increases. The increases are incremental but are not typically linear in nature due to the dependence of weight on the square of the diameter. This provides for consistent appearance of the weights in a set and functional stacking.

Figure 3:
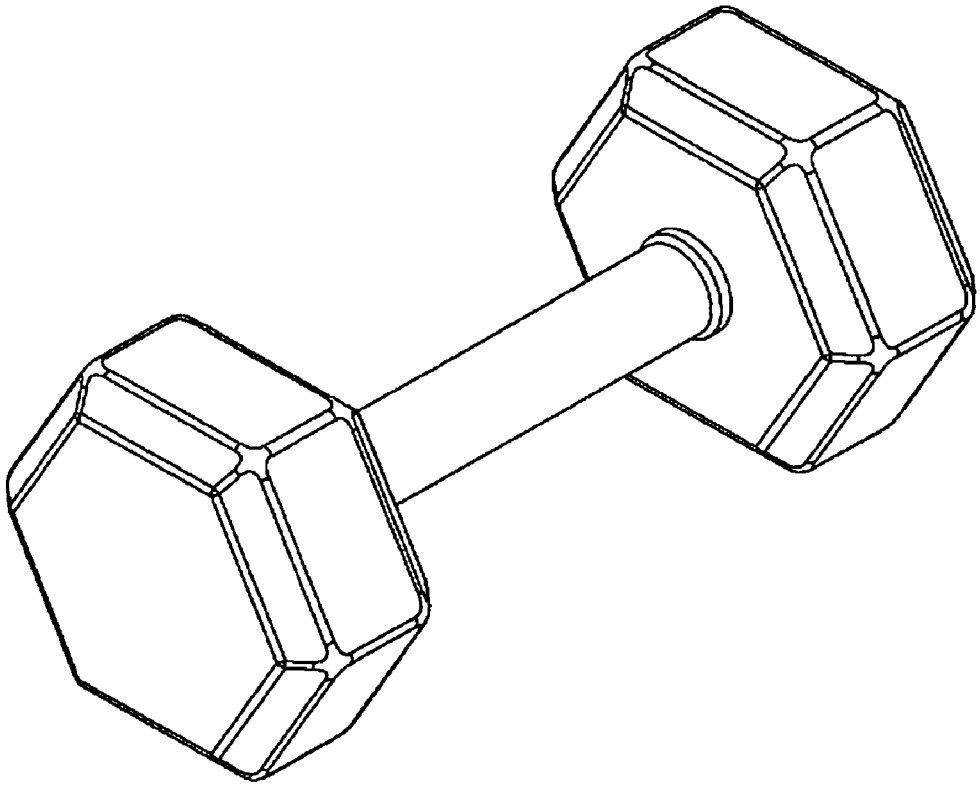
Fig. 3 Prior Art
FIG. 3 is a perspective view of a prior art dumbbell with hexagonally shaped end weights.
Figure 4:
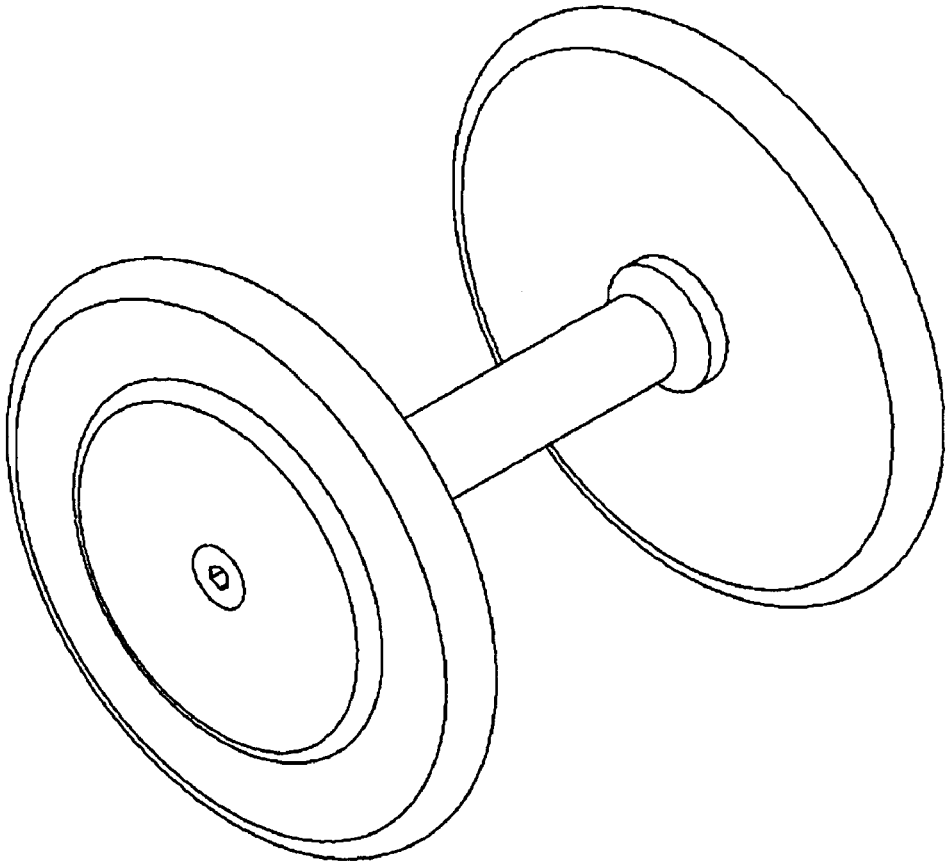
Fig. 4 Prior Art
FIG. 4 is a perspective illustration of a prior art dumbbell with circular weight plates.
Figure 5C:
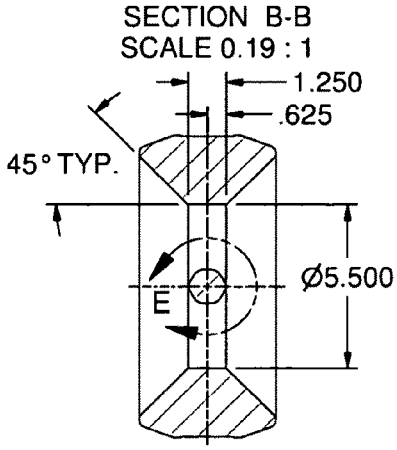
FIG. 5C is a top sectional view of the circular free weight of FIG. 5B taken along line B-B.
Figure 5A:
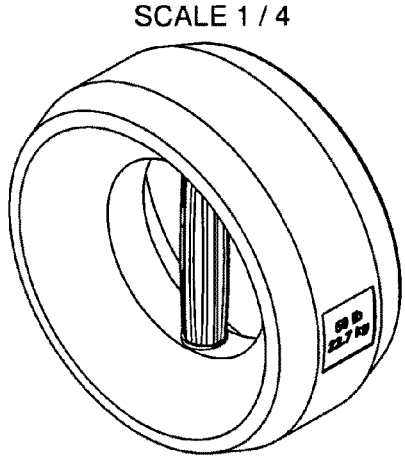
FIG. 5A is a perspective view of a 50 pound circular free weight according to the present invention.
Figure 5B:
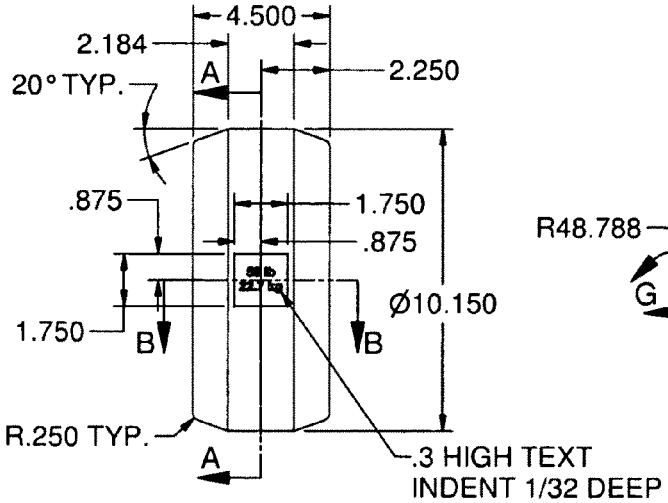
FIG. 5B is a front plan view of the circular free weight of FIG. 5A.
Figure 5D:
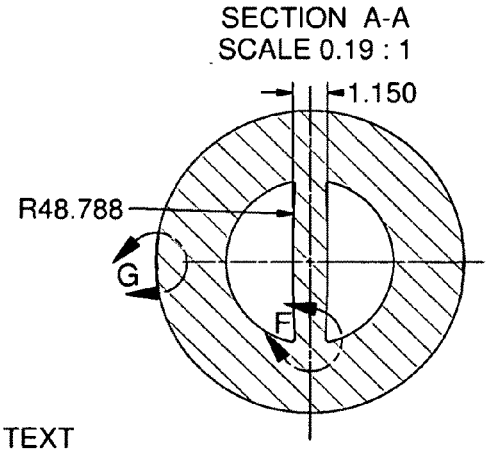
FIG. 5D is a side sectional view of a free weight of FIG. 5B taken along the line A-A.
Figure 5E:
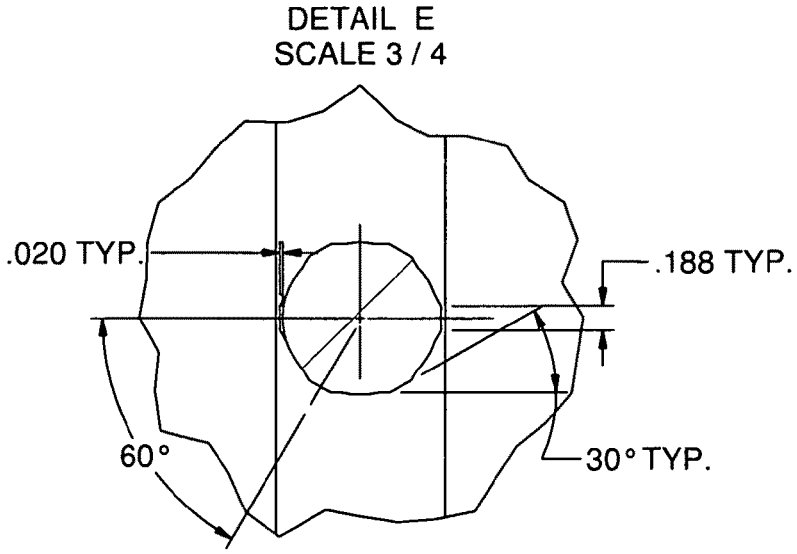
FIG. 5E is an enlarged plan view of the section designed E in FIG. 5C showing the position of the handle within the circular free weight.
Figure 5G:
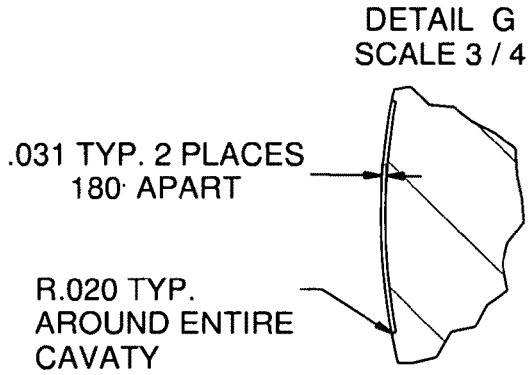
FIG. 5G is an enlarged sectional plan view of the section designated G in FIG. 5D illustrating an outer edge of the free weight.
Figure 5F:
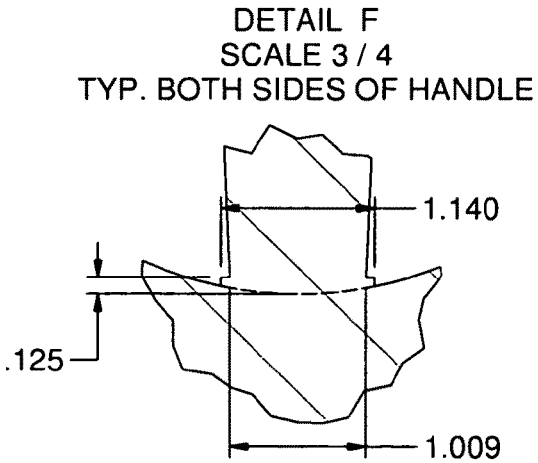
FIG. 5F is an enlarged sectional view of the section designated F in FIG. 5D illustrating the junction of the handle to the circular free weight.

The circular free weights of the present invention also provide for improved manufacturability. Standard prior art dumbbells are made by one of two ways:

1) Ends are cast from pig iron and then are welded to a handle that has been fabricated by extrusion, casting, or machining as shown in FIG. 3; or 2) Multiple cast circular plates are screwed to a similar handle as shown in FIG. 4.

The manufacturing processes for most prior art dumbbells therefore requires multiple parts and assembly processes. These assembly processes are expensive and more importantly are prone to failure, particularly at the union of components, causing potential safety concerns. The safety issue is of increased concern as the individual free weight is heavier and when free weights are used in crowded gyms. Circular balanced free weights according to the invention may be cast in one piece and therefore are more economical to manufacture, are permanently joined, and safe.

An array of functional architectural parameters for a weight set having weights of 2.5 lbs, 7.5 lbs, 10 lbs, 12.5 lbs, 15 lbs, 17.5 lbs, 20 lbs, 25 lbs, 30 lbs, 35 lbs, 40 lbs, 45 lbs, 45 lbs, 50 lbs, 60 lbs, 70 lbs, 80 lbs, 90 lbs, and 100 lbs are listed in Table 1A. A similar set of functional architectural parameters for a metric weight set of 1 to 45.5 kilograms are listed in Table 1B.

TABLE 1A

Architectural Parameters
for
2.5 lb to 100 lb weight series
$D_i$ = 5.5 inches; $D_H$ = 1.25 inches; $\theta$ = 45°

| | Architectural Parameters | | |
|---|---|---|---|
| Weight (lbs) | $D_o$ | H | $\tau$ |
| 2.5 | 6.016 | 1.508 | 0.129 |
| 5.0 | 6.429 | 1.732 | 0.158 |
| 7.5 | 6.857 | 2.007 | 0.212 |
| 10.0 | 7.203 | 2.246 | 0.250 |
| 12.5 | 7.486 | 2.500 | 0.250 |
| 15.0 | 7.755 | 2.701 | 0.250 |
| 17.5 | 8.000 | 2.884 | 0.250 |
| 20.0 | 8.225 | 3.053 | 0.250 |
| 25.0 | 8.630 | 3.358 | 0.250 |
| 30.0 | 8.990 | 3.627 | 0.250 |
| 35.0 | 9.314 | 3.871 | 0.250 |
| 40.0 | 9.611 | 4.096 | 0.250 |
| 45.0 | 9.886 | 4.305 | 0.250 |
| 50.0 | 10.143 | 4.500 | 0.250 |
| 60.0 | 10.611 | 4.857 | 0.250 |
| 70.0 | 11.031 | 5.179 | 0.250 |
| 80.0 | 11.414 | 5.473 | 0.250 |
| 90.0 | 11.767 | 8.746 | 0.250 |
| 100.0 | 12.096 | 6.000 | 0.250 |

TABLE 1B

Architectural Parameters
For
1 kg to 45 kg Weight
$D_i$ = 2.16 cm; $D_H$ = 0.49 cm $\theta$ = 45°

| Weight | Architectural Parameters | | |
|---|---|---|---|
| (Kilograms) | $D_o$ | H | $\tau$ |
| 1.0 | 2.36 | 0.59 | 0.05 |
| 2.2 | 2.53 | 0.68 | 0.06 |
| 4.5 | 2.84 | 0.88 | 0.10 |
| 6.8 | 3.05 | 1.06 | 0.10 |
| 9.09 | 3.24 | 1.20 | 0.10 |
| 13.6 | 3.54 | 1.43 | 0.10 |
| 18.2 | 3.78 | 1.61 | 0.10 |
| 22.7 | 3.88 | 1.77 | 0.10 |
| 27.3 | 4.18 | 1.81 | 0.10 |
| 36.36 | 4.49 | 2.15 | 0.10 |
| 48.45 | 4.76 | 2.36 | 0.10 |

TABLE 1C

| Interrelationship For Between $D_o^2$ and H for 2.5 and 100 Pound Weight Set | | | |
|---|---|---|---|
| Weight (lbs) | H (inches) | $D_o^2$ (inches) | $\frac{D_o^2}{H}$ (inches) |
| 2.5 | 1.551 | 36.19 | 24.00 |
| 5.0 | 1.557 | 41.28 | 23.83 |
| 7.55 | 2.501 | 47.02 | 23.42 |
| 10.0 | 2.250 | 54.88 | 23.10 |
| 12.5 | 2.500 | 57.04 | 22.40 |
| 15.0 | 2.700 | 60.14 | 22.27 |
| 17.5 | 2.880 | 64.00 | 22.19 |
| 20.0 | 3.050 | 67.65 | 22.16 |
| 25.0 | 3.560 | 74.48 | 22.18 |
| 30.0 | 3.630 | 80.82 | 22.28 |
| 35.0 | 3.870 | 86.75 | 22.41 |
| 40.0 | 4.100 | 92.37 | 22.55 |
| 45.0 | 4.310 | 97.73 | 22.70 |
| 50.0 | 4.500 | 102.88 | 22.86 |
| 60.0 | 4.860 | 112.59 | 23.18 |
| 70.0 | 5.180 | 121.68 | 23.49 |
| 80.0 | 5.470 | 130.28 | 23.80 |
| 90.0 | 5.750 | 138.46 | 24.10 |
| 100.0 | 6.000 | 146.31 | 24.38 |

Average = 22.90

TABLE 1D

| Interrelationship Between Weight and $D_o^2H$ for a 10.0 to 100 Pound Weight Set | | |
|---|---|---|
| Weight (lbs) | $D_o^2H$ (inches) | $\frac{W}{D_o^2H}$ |
| 10.0 | 116.5 | 0.086 |
| 12.5 | 140.1 | 0.089 |
| 15.0 | 162.4 | 0.092 |
| 17.5 | 184.6 | 0.095 |
| 20.0 | 206.5 | 0.097 |
| 25.0 | 250.1 | 0.100 |
| 30.0 | 293.5 | 0.102 |
| 35.0 | 335.9 | 0.104 |
| 40.0 | 378.4 | 0.106 |
| 45.0 | 420.7 | 0.107 |
| 50.0 | 463.0 | 0.108 |
| 60.0 | 546.9 | 0.109 |
| 70.0 | 630.2 | 0.110 |
| 80.0 | 713.5 | 0.111 |
| 90.0 | 795.6 | 0.112 |
| 100.00 | 877.9 | 0.113 |

Average = 0.102

TABLE 1E

| Interrelationship Between Weight and $D_o^2H$ for a 4.5 kg. to A 45.5 kg Weight Set | | | | |
|---|---|---|---|---|
| Weight (kg) | $D_o^2$ ($CM^2$) | H (CM) | $D_o^2H$ ($CM^3$) | $\frac{W}{D_o^2H}$ ($Kg/CM^3$) |
| 4.5 | 8.07 | 0.88 | 7.10 | 0.63 |
| 5.7 | 8.90 | 0.98 | 8.53 | 0.66 |
| 6.8 | 9.30 | 1.06 | 8.86 | 0.69 |
| 7.9 | 9.92 | 1.14 | 11.31 | 0.70 |
| 9.1 | 10.50 | 1.20 | 12.60 | 0.72 |

TABLE 1E-continued

| Interrelationship Between Weight and $D_o^2H$ for a 4.5 kg. to A 45.5 kg Weight Set | | | | |
|---|---|---|---|---|
| Weight (kg) | $D_o^2$ ($CM^2$) | H (CM) | $D_o^2H$ ($CM^3$) | $\frac{W}{D_o^2H}$ ($Kg/CM^3$) |
| 11.4 | 11.56 | 1.32 | 15.26 | 0.75 |
| 13.6 | 12.53 | 1.48 | 17.82 | 0.76 |
| 15.9 | 13.44 | 1.52 | 20.37 | 0.78 |
| 18.2 | 14.29 | 1.81 | 23.00 | 0.79 |
| 22.7 | 15.92 | 1.77 | 28.18 | 0.80 |
| 27.3 | 17.47 | 1.91 | 38.37 | 0.82 |
| 31.8 | 18.84 | 2.04 | 38.43 | 0.83 |
| 38.4 | 20.16 | 2.15 | 43.34 | 0.84 |
| 40.9 | 21.44 | 2.26 | 48.45 | 0.84 |
| 45.5 | 22.66 | 2.36 | 58.48 | 0.85 |

Average = 0.76

Range = ±0.11

Figure 6:
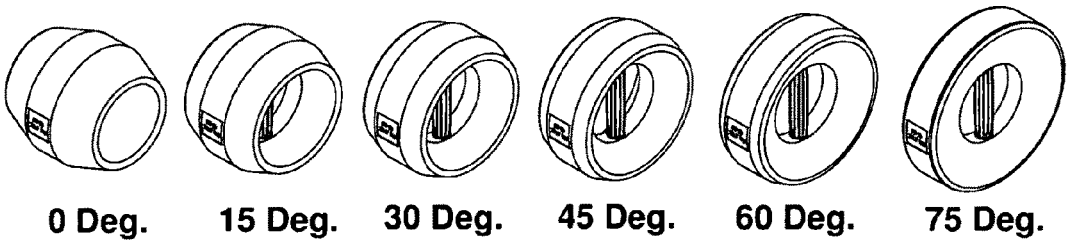
FIG. 6 is an illustration of six 50 pound circular weights manufactured with internal draft angles $\theta$ varied between 0 degrees and 75 degrees.

FIGS. 5A through 5G illustrate the 50 pound weight from the weight set described in Table 1A. It may be observed that the interplay between the various architectural parameters $D_o$, H and $\tau$ meet the recommended range of parameters described above. While the listed set of parameters is very functional, modest variations between the parameters also generate a functional set of weights. The variations between the parameters $D_o$, H and $\theta$ for a 50 pound weight are shown in FIG. 6 and it is readily observed that for draft angles $\theta$ outside the range of 30° to 60° the weight configuration is less desirable. If weight set ranges are reduced so that the weights range only from 5 lbs to 50 lbs or from 5 lbs to 25 lbs, then greater variations between the critical parameters are allowed. In no instance, however, can the interplay between the controlling architectural developments be ignored.

To more fully explore the interplay between the architectural parameters, Table 2 includes charts 2A, 2B, 2C, 2D, 2E and 2F. Charts 2A, 2C, and 2E show the influence of fixing height, H, while allowing the inside draft angle, $\theta$, to vary for 100 pound, 50 pound, and 25 pound weights. Notice at angles, $\theta$, greater than 45°, it is not possible to get an outside diameter $D_o$ within the most desirable range. Similarly, charts 2B, 2D and 2F show the influence of fixing the outside diameter, $D_o$, while allowing the inside angle $\theta$ to vary for 100 lbs, 50 lbs, 25 lb weights. Again, it is not possible to get a match for height H within the most desirable range at angles greater than 45°. Because the total weight is controlled by separate functions, the outside diameter $D_o$ height H and angle $\theta$, it is necessary in order to get the best fit for a given draft angle $\theta$ to allow these two parameters to vary together. By imposing the controlling parameters as listed, while allowing the outside diameter and height to vary in unison, it follows that optimum weight series are obtained when the internal angle, $\theta$ is between 30° and 60° and more preferably between 40° and 50°. The influence of allowing the internal angle, $\theta$ to vary between 0 and 75 for a 50 lb weight is shown in FIG. 6.

TABLE 2

Interplay between Outside Diameter, Height and Internal Angle for 100 lb, 50 lb, and 25 lbs
Fixed Elements: Inside Diameter ($D_i$) = 5.5 inches; Radius of Curvature = 0.25 inches

| $D_0$ | Height | Inside Angle θ | $D_0$ | Height | Inside Angle θ |
|---|---|---|---|---|---|
| 2A 100 lb O.D. Variable | | | 2B 100 lb Height Variable | | |
| 10.902 | 6.0 | 0 | 12.095 | 4.305 | 0 |
| 11.194 | 6.0 | 15 | 12.095 | 4.465 | 15 |
| 11.555 | 6.0 | 30 | 12.095 | 4.746 | 30 |
| 12.095 | 6.0 | 45 | 12.095 | 6.00 | 45 |
| N/A* | 6.0 | 60 | 12.095 | N/A* | 60 |
| N/A* | 6.0 | 75 | 12.095 | N/A* | 75 |
| 2C 50 lb O.D. Variable | | | 2D 50 lb Height Variable | | |
| 9.345 | 4.50 | 0 | 10.15 | 3.356 | 0 |
| 9.540 | 4.50 | 15 | 10.15 | 3.469 | 15 |
| 9.784 | 4.50 | 30 | 10.15 | 3.668 | 30 |
| 10.15 | 4.50 | 45 | 10.15 | 4.50 | 45 |
| N/A | 4.50 | 60 | 10.15 | N/A | 60 |
| N/A | 4.50 | 75 | 10.15 | N/A | 75 |
| 2E 25 lb O.D. Variable | | | 2F 25 lb Height Variable | | |
| 8.145 | 3.356 | 0 | 8.630 | 2.655 | 0 |
| 8.265 | 3.356 | 15 | 8.630 | 2.730 | 15 |
| 8.413 | 3.356 | 30 | 8.630 | 2.863 | 30 |
| 8.630 | 3.356 | 45 | 8.630 | 3.356 | 45 |
| N/A | 3.356 | 60 | 8.630 | N/A | 60 |
| N/A | 3.356 | 75 | 8.630 | N/A | 75 |

*N/A - Outside Most Preferred Range

Dimensions for $D_0$, H and θ are listed in the accompanying Table 3 corresponding to the weights in FIG. 6.

TABLE 3

Accompanying Data for 50 lb. Weight Series Shown in FIG. 6

| $D_0$ | Height | Inside Angle θ |
|---|---|---|
| 8.488 | 8.057 | 0 |
| 9.110 | 6.339 | 15 |
| 9.626 | 5.316 | 30 |
| 10.150 | 4.500 | 45 |
| 10.802 | 3.705 | 60 |
| 11.829 | 2.777 | 75 |

Therefore, it will be seen that while great freedom is available in the design parameters applied to light weights in this circular design, less than about 15 pounds or 7 kilograms, the design parameters become critical for the heaver weights to be both functional and of consistent appearance. In particular, apart from the general constraints on the parameters discussed above, it is desirable that the ratio of the square of the outer diameter ($D_o^2$) to the height H be between about 21 and 25 to 1. In addition, the ratio of the weight in pounds of a circular weight of at least 10 pounds to its outer diameter squared, times its height ($HD_o^2$), should be between about 0.08 and about 0.12 and preferably between 0.09 and 0.11 to 1.

All publications, patent, and patent documents mentioned herein are incorporated by reference herein as though individually incorporated by reference. Although preferred embodiments of the present invention have been disclosed in detail herein, it will be understood that various substitutions and modifications may be made to the disclosed embodiment described herein without departing from the scope and spirit of the present invention as recited in the appended claims.

I claim:

1. A set of balanced circular free weights of weights ranging between the heaviest weight in the set and the lightest weights in the set by at least ten pounds wherein the weights in the set are characterized by a circular weight member having an inner diameter defining central opening and a handle extending across the diameter of the central opening; the circular weight member having an outer diameter ($D_o$) and a height; the wall of the circular weight member extending outward from the inner central portion at a draft angle (θ) to an outmost section having a radius of curvature (τ) wherein the outer diameters is no greater than 13 inches, the height is no greater than 7 inches, and the draft angle is between 20° and 70°.

2. The set of balanced circular weights of claim 1 wherein the height is no greater than 6 inches.

3. The set of balanced circular weights of claim 1 wherein the height is no greater than 4.5 inches.

4. The set of balanced circular weights of claim 1 wherein the height is no greater than 2.5 inches.

5. The set of balanced circular weights of claim 1 wherein the outer diameter is no greater than 12 inches.

6. The set of balanced circular weights of claim 1 wherein the outer diameter is no greater than 10 inches.

7. The set of balanced circular weights of claim 1 wherein the outer diameter is no greater than 7.5 inches.

8. The set of balanced circular weights of claim 1 wherein the draft angle is between 30° and 60°.

9. The set of balanced circular weights of claim 1 wherein the draft angle is between 40° and 50°.

10. The set of balanced circular weights of claim 1 wherein the radius of curvature is at least 0.125 inches.

11. A set of balanced circular free weights varying in weight by at least ten pounds between the heaviest weight in the set and the lightest weight in the set, said heaviest weight having a weight of at least 12.5 pounds and said weights being characterized by a circular weight with a central opening defined by an inner diameter and having a handle extending across a diameter of the central opening; and the circular weight having height and an outer diameter; wherein the ratio of the outer diameter squared to the height of each weight of at least twenty pounds in the set is between 21 and 25.

12. The set of balanced circular free weights of claim 11 wherein the ratio of the outer diameter squared to the height of each weight in the set is less than 2.5.

13. The set of balanced circular free weights of claim 11 wherein the inner diameter of the circular weight of each weight of at least twenty pounds in the set extends outward at a draft angle of between 30° and 60°.

14. The set of balanced circular free weights of claim 11 wherein the inner diameter of the circular weight of each weight of at least twenty pounds in the set extends outward at a draft angle of between 40° and 50°.

15. The set of balanced circular free weights of claim 11 wherein the height and outer diameter of each weight in the weight set increase incrementally within increases of weight.

16. A set of balanced circular free weights varying in weight by at least ten pounds between the heaviest weight in the set and the lightest weight in the set, said heaviest weight having a weight of at least 12.5 pounds and said weights being characterized by a circular weight with a central opening defined by an inner diameter and having a handle extending across a diameter of the central opening; and the circular weight having height and an outer diameter; wherein the ratio of the weight to the square of the diameter times the height of each weight of at least 12.5 pounds in the set is between 0.08 and 0.12.

17. The set of balanced circular free weights of claim 16 wherein the ratio of the weight to the square of the outer diameter times the height of each weight of at least 12.5 pounds in the set is between 0.09 and 0.11.

18. The set of balanced circular free weights of claim 16 wherein the ratio of the outer diameter squared to the height of each weight is between 21 and 25.

19. The set of balanced circular free weights of claim 16 wherein the inner diameter of the circular weight of each weight of at least twenty pounds in the set extends outward at a draft angle of between 30° and 60°.

20. The set of balanced circular free weights of claim 16 wherein the inner diameter of the circular weight of each weight of at least twenty pounds in the set extends outward at a draft angle of between 40° and 50°.

* * * * *